United States Patent [19]

Yazawa et al.

[11] 3,953,909

[45] May 4, 1976

[54] METHOD FOR PRODUCING LATERALLY SPREAD RETICULAR WEB OF SPLIT FIBERS

[75] Inventors: Masahide Yazawa, Kunitachi; Kazuhiko Kurihara; Haruhisa Tani, both of Tokyo; Masaki Matsumoto, Higashikurume, all of Japan

[73] Assignee: Polymer Processing Research Institute Ltd., Tokyo, Japan

[22] Filed: Aug. 23, 1974

[21] Appl. No.: 500,205

[30] Foreign Application Priority Data

Aug. 24, 1973 Japan ..... 48-94962

[52] U.S. Cl. ..... 19/161 R; 28/DIG. 1

[51] Int. Cl.[2] ..... D04H 11/00

[58] Field of Search ..... 19/161 R; 28/1 R, 1 CF, 28/DIG. 1; 26/51, 54

[56] References Cited

UNITED STATES PATENTS

| | | | |
|---|---|---|---|
| 3,303,547 | 2/1967 | Kalwaites | 19/161 R |
| 3,708,831 | 1/1973 | Burger | 19/161 R |
| 3,808,639 | 5/1974 | Tautvaisas | 19/161 R |

FOREIGN PATENTS OR APPLICATIONS

| | | | |
|---|---|---|---|
| 923,963 | 4/1963 | United Kingdom | 19/161 R |

*Primary Examiner*—Louis K. Rimrodt
*Attorney, Agent, or Firm*—Fred Philpitt

[57] ABSTRACT

A stabilized laterally spread reticular web of split fibers is produced by feeding a web of split fibers onto a plurality of belts in side-by-side arrangement on the inlet side thereof, the belts circulating between an inlet-side roller and an outlet-side roller, the advancing route of the belts being planely diverging and the returning route of the belts being planely converging, making the surfaces of at least the belts among the plurality of belts, on which both the side edge parts of the web are placed, wet with a liquid, preferably water containing a small amount of a surfactant, laterally spreading the web on the advancing route of the belts to a given lateral spreading ratio, while temporarily fixing both the side edge parts of the web onto the belts by the surface tension of the liquid, withdrawing the web onto a rotating hot drum through a guide rod, applying suctions to both the side edge parts of the web on the drum, in order to laterally spread slacking side edge parts of the web outwards by the suctions, and drying and heat-treating the laterally spread web while travelling the laterally spread web from one drum to another in a series of several drums, thereby eliminating strains due to the lateral spreading. The resulting web is suitable for producing non-woven fabrics by lamination.

4 Claims, 4 Drawing Figures

METHOD FOR PRODUCING LATERALLY SPREAD RETICULAR WEB OF SPLIT FIBERS

DESCRIPTION OF THE INVENTION

This invention relates to a method for producing a laterally spread, reticular web of split fibers as an important petreatment for producing a non-woven fabric having a small basis weight and a high strength, by laterally spreading a web of split fibers having a reticular structure obtained by splitting a stretched film, to several times the original width of the stretched film, placing at last two of the resulting web one upon another crosswise as well as in parallel without slacking and fixing the webs by an adhesive paste, and also to a method for producing a laterally spread web stabilized by heat treatment after further respreading both the side edge parts of the spread web.

The present invention is characterized in that a web of split fibers is placed on a plurality of belts in side-by-side arrangement circulating in a planely diverging manner on the advancing route thereof to have the width on the outlet-side thereof corresponding to a given lateral spreading ratio in relation to the inlet-side width, and in a planely converging manner on the returning route thereof towards the inlet-side; the surfaces of at least the belts among the plurality of belts, on which both the side edge parts of the web are to be placed, are wetted with a liquid, preferably a water, to attach both the side edge parts of the web onto the belts by the surface tension of water; the web is laterally spread by planely diverging track of the belts, while both the side edge parts of the web being temporarily fixed onto the wetted belts; when the lateral spreading of the web has reached the given ratio thereof, the laterally spread web is peeled off from the surfaces of the belts and withdrawn to the successive step through a guide, at a lower speed than the feeding speed of the web, by a speed corresponding to the shrinkage of the web in the longitudinal direction, due to the lateral spreading alone; and the web is eventually heat-treated to eliminate strains due to lateral spreading, whereby a stabilized, laterally spread web is obtained.

The present inventors disclosed a system for laterally spreading a web by applying an adhesive paste to belts in planely diverging track, fixing side edges of the web to the pasted belts by pressing and laterally extedning the web through the lateral diverging of the belt track in a method for producing a spread non-woven fabric of split fiber webs of large width (Japanese Pat. Publication No. 2785/72; Japanese Pat. No. 653110), but, due to the remaining paste residue on the web, the web sticks to the vessel walls or coils around rollers here and there in the successive drying and heat-treating steps, or lateral spreading at the pasted parts becomes impossible. Thus, the pasted side edge parts must be cut off after the lateral spreading, which means a loss of the web as well as complicated operation and controls. Thus, improvement has been needed.

As the result of further studies, the present inventors found that, when the belts at both the edge parts of the planely diverging track are wetted only with water, in most cases, water containing a very small amount of a surfactant to make the belts uniformly wet, both of the side edge parts of the web is temporarily fixed to the belts at the respective edge parts by the surface tension of water, and never peeled off from the edge part belts only owing to the force of adhesion or the surface tension of water there, so long as no excessive tension is applied in the longitudinal direction of the web at the laterally spreading step.

When a reticular article is laterally spread, the longitudinal dimension thereof is shortened with the increase in lateral spreading ratio. Therefore, when the web is to laterally spread at an equal speed at both feeding and withdrawing points without making the withdrawing speed of the web after laterally spread, slower than the feeding speed of the web, a tension will be imposed on the web. If the tension is imposed in the longitudinal direction, the web is liable to be torn longitudinally when laterally spead, or the two side edge parts of the web are liable to be peeled off from the belt surfaces while being drawn inwardly, because the laterally spread web becomes narrow when a tension is applied in the longitudinal direction. To laterally spread the web under a more or less tension, it has been necessary to use a paste in order to intensify the adhesion of the side edge parts of the web onto the belts.

After further experiments, however, the present inventors have found that, when, among the plurality of belts running at a speed equal to that of the web, only the belts on which both the side edge parts of the web are placed, are wetted with only water, and the belts at the middle position between the two edge belts are not wetted with water but are made to run as belts for merely supporting the weight of the web, the web at the middle position between both the edge sides are uniformly laterally spread and longitudinally shortened, while the parts of the web placed on the water-wetted side edge belts are not laterally spread, run together with the belts and thus are not longitudinally shortened. That is to say, it has been found that, when the entire web is peeled off from the belts upward at a speed of withdrawal suitable for the laterally spread part of the web, the laterally not spread side edge parts of the web are withdrawn in a slacked, corrugate form to the successive step together with the laterally spread middle part. When all the plurality of belts run at a feeding speed of the web, and only the belts on which the side edge parts of the web are placed, are wetted with water, the laterally spread part of the web can be supported by the belts running at a slightly faster speed, while the web being slightly hauled and slided. This means that, if the belts are made to run at a speed of withdrawal of the web after being laterally spread, the web should be supplied onto the belts on the inlet side excessively enough to meet the shrinkage caused by the lateral spreading.

If all of the plurality of belts are wetted with water, the parts of the web sticking to the belts with water are not laterally spread during the course of the whole lateral spreading. When the laterally spread web is withdrawn onto a roller, for example, a hot drum, through a guide rod, the parts of the web sticking to the belts are not laterally spread as stated before, and therefore a web with a plurality of slacked, corrugated creased bands is obtained on the drum. The laterally spread, unwetted parts of the web undergo more or less heat shrinkage on the hot drum, and there develops a tension, which has an influence on each of the adjacent laterally not spread, wet parts of the web. Consequently, the laterally not spread, wet parts of the web are further laterally pulled on the outlet side of the hot drum, and excessively laterally spread, if the laterally spread parts of the web undergo much heat shrinkage.

When at least two hot drums are employed in series, however, parts of the web, having been wetted on the belts and being excessively laterally spread on one drum, undergo heat shrinkage to have much tension, as drying of said parts proceeds, and as a result, contrary to the behavior before drying, said parts attract parts of the web, having not been wetted on the belt and being normally spread on one drum in the course of travelling from one hot drum to another, and the lateral spreading is made uniform on the whole, while the web travels from one drum to another. However, even if the wetted side edge parts of the web are pulled towards the laterally spread middle part of the web on the hot drum, the side edge parts are not laterally spread, because the side edge parts are in a slacked state and are not in a fixed state.

Therefore, just after the laterally spread web is withdrawn onto the first hot drum through a guide rod, the left side edge part is drawn towards the left direction, and the right side edge part towards the right direction by the respective suctions of negative pressure, while the wet side edge parts of the web are not dried and are in a slacked state. The side edge parts are subject to forces in the lateral direction, that is, a force from the inside due to the heat shrinkage of the unwetted web, and a force from the outside due to the suction. Therefore, the side edge parts, which are wetted and not laterally spread on the belts, are generally subject to more excessive lateral spreading, while travelling along the surface of the hot drum, then the middle part of the web, and laterally spread web having a higher lateral spreading ratio at the side edge parts can be obtained. Then the slacking at the side edge parts are eliminated as the result of attracting the side edge parts to the outside directions followed by the lateral further spreading. As another method for laterally spreading the slacking at the side edge parts of the web, there are also available a method of blowing the slacked parts of the web at the drum edge parts outwards by compressed air to laterally spread the slacking, a method of wiping out the slacking outwards by rotating brushes to laterally spread the slacking, etc. Anyway, when at least two sheets of laterally spread webs are placed upon one another as weft and warp webs, a web having a higher lateral spreading ratio at the side edge parts is used preferably as weft web, because, when the web having a higher lateral spreading ratio at the side edge parts is cut off repeatedly in accordance with the width of the warp web and made to fall intermittently upon a running warp web as the weft layer, the eventually overlapped edge parts of successively fallen cut weft webs can have a fiber density similar to that of other parts, that is, the middle part, because of the low fiber density at the side edge parts of the web for weft, and the resulting laminate product can have a uniform quality. There is a case where only the uniformly laterally spread middle part can be practically used by cutting off the laterally not spread edge parts without carrying out said further lateral spreading treatment of the web, but such is not advantageous in view of the yield of the product.

Now, the present invention will be illustrated in detail by way of the accompanying drawings.

Figure 3A:
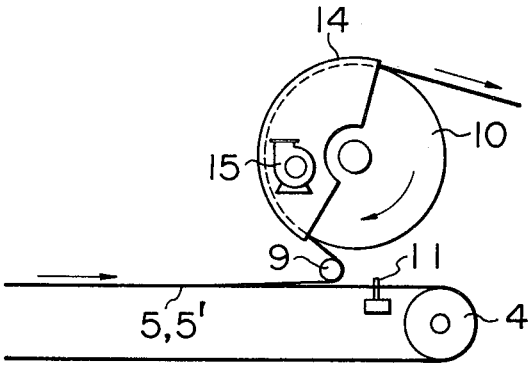
Figure 3B:
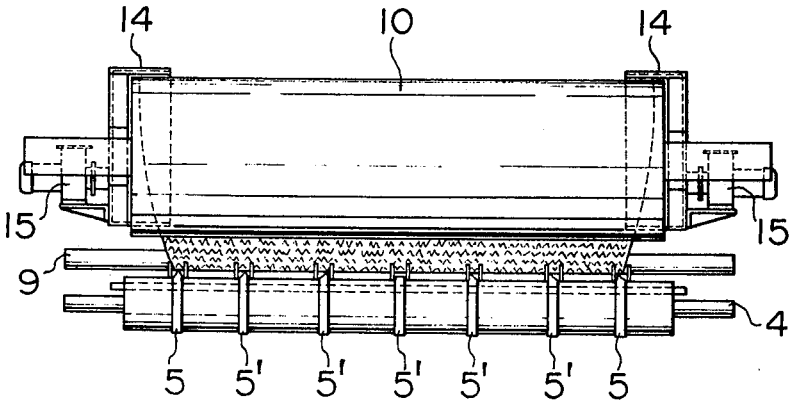

FIGS. 3*a* and 3*b* are enlarged side view and enlarged elevational view, respectively, of a part of withdrawing laterally spead web onto a hot drum.

Figure 1:
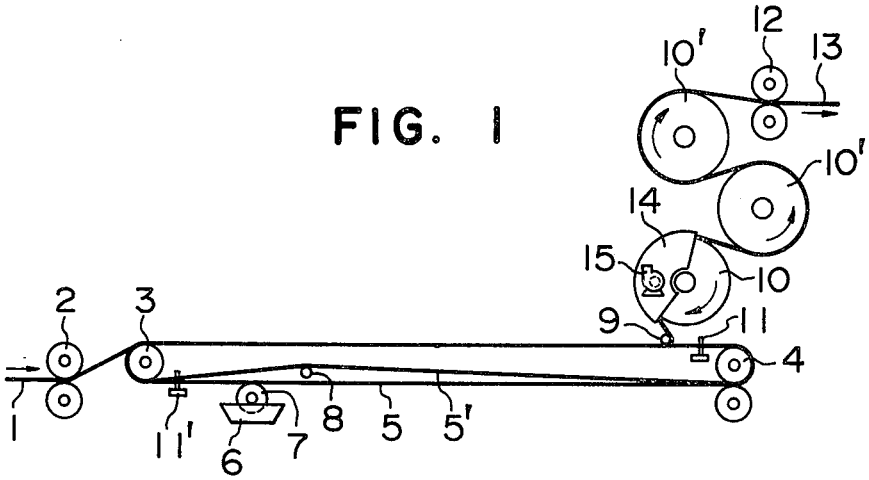
FIG. 1 is a schematic side view for carrying out the present invention.
Figure 2:
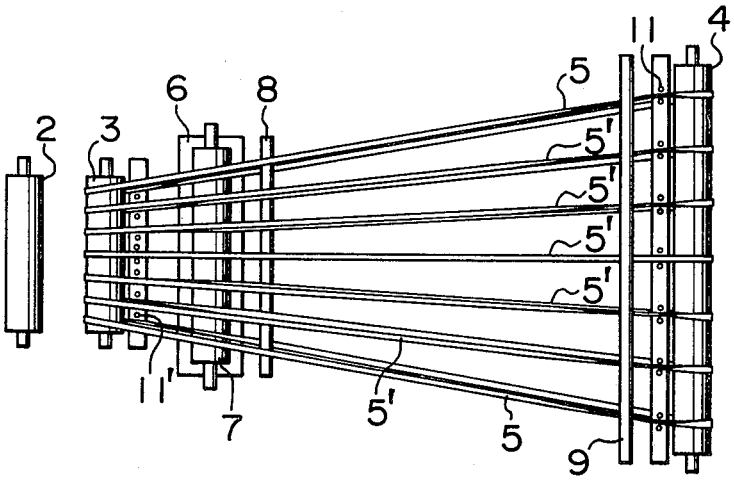
FIG. 2 is a plan view of FIG. 1 (hot drums are omitted).

In FIGS. 1 and 2, split reticular web 1 is placed through pinch rollers 2 onto a plurality of belts in side-by-side arrangement consisting of edge belts 5 onto which the side edge parts of the web are attached and middle part belts 5' and being circulated between roller device 3 and pinch roller device 4, situated a sufficient distance apart and in a planely diverging manner on the advancing route to have the width on the outlet-side thereof corresponding to a given lateral spreading ratio of the web in relation to the inlet-side, and in a planely converging manner on the returning route towards the inlet-side at a speed equal to a feed speed of the web. The surfaces of edge belts 5 are wetted with water in contact with wetting roller 7 rotating in water tank 6 in a half-submerged state, and middle belts 5' are running usually without any contact with the wetting roller, that is, without wetting, by guidance with rod 8, merely for supporting the middle part of the web. The web is laterally spread to a desired lateral spreading ratio (usually two to four times the original width) with an increasing width of the belt track, and at this point, the laterally spread web is peeled off from the belts through guide rod 9 onto hot drum 10 placed above the belts at a speed suitable enough not to exert any excessive tension on the laterally spread web and made to travel over several hot drums 10' from one to another.

Belts of any quality and any cross-sectional shape can be used, but usually thin, flat belts of synthetic resin, rubber, etc. having a thickness of 1 to 2 mm and a width of 10 to 30 mm are used.

When rollers 3 and 4 are cylindrical ones provided in parallel, guide combs 11 and 11' are usually provided on the belt-approaching side to rollers 4 and 3, respectively, so that a plurality of the belts can take a planely diverging track. Therefore, the laterally spread web must be withdrawn upwards through guide rod 9 before the belts reach comb 11. Generally, the lateral spreading ratio of the web is in a range of 2–4:1, and the shrinkage of the web in the longitudinal direction due to the lateral spreading depends upon the mean width (size) and length of individual single split fibers constituting a net structure, but the shrinkage is, in most cases, within a few percents when the ordinary, well known splitter is used. A proper speed of withdrawal of the laterally spread web can be readily determined experimentally in accordance with the changes in the lateral spreading ratio of the raw web, if a speed of drum 10 is made finely adjustable against pinch rollers 2 for feeding the web. The lateral spreading ratio can be properly changed for the same raw web simply by changing intervals of the teeth rods of comb 11, through which the belts are passed, respectively.

Since the laterally not spread side edge parts are few percents longer than the laterally spread middle part of the web, said parts undergo corrugated (or wavy) creasing in the laterally spreading step, but said parts can be withdrawn in a slacked state together with the laterally spread part, and thus there is no trouble in continuous operation.

When the web is laterally spread, split fibers of flat sections constituting the net meshes have such a tendency that the flat surfaces are inclined or twisted-up against the laterally spead surfaces, and when the strain forces of lateral spreading are removed, the twisted-up sections from flat surfaces are liable to return to the original flat state immediately. On the other hand, when the web is heat-treated in the laterally spread state, the twisted-up from flat split fibers are made flat in the laterally spread surfaces, the strain forces of lateral spreading are eliminated, and the web is stabilized in the laterally spread state. Therefore, it is usually necessary to heat-set the web just after the lateral spreading, while keeping as it is.

For this purpose, a free path must be made as short as possible in the withdrawal of the laterally spread web, that is, a distance between guide rod 9 and belts 5, 5' and also a distance between guide rod 9 and hot drum 10 must be made short.

The laterally spread web withdrawn onto hot drum 10 is heated, and in most cases slightly shrinks. If the web of split fibers is thoroughly heat-treated in the step of preparing the web, the shrinkage on the hot drum is small.

Optimum heat-setting temperature of the laterally spread web is an annealing temperature of the split fibers, but when a temporary fixing of the laterally spread state is desirable, the heat-setting temperature may be a little lower than the annealing temperature.

Anyway, the web parts, which are wetted with water on the belts, are creased in wavy forms, when withdrawn onto the drum, but when the adjacent, laterally spread parts undergo heat shrinkage or when a tension is applied to the web from second hot drum 10' in succession to first hot drum 10, resulting thereby in the width of the laterally spread web being narrowed on the first hot drum, the slacked, laterally not spread wet web parts are laterally spread, and are moved from first hot drum 10 to second hot drum 10' in a more widely, laterally spread state than the other, ordinarily laterally spread parts. This phenomena are very remarkable when the belts supporting the middle parts of the web are wetted with water. However, when the water-wetted parts are dried and heated on the hot drum, the strongly laterally spread parts are subject to a higher tension of shrinkage, and therefore the unevenness in the lateral spreading is corrected while the web moves from one hot drum to another, and evenly laterally spread web 13 is obtained through pinch rollers 12. When the webs are dried and heat-set on the first hot drum 10 alone by making its diameter larger instead of travelling over a series of several hot drums, the wet, laterally not spread parts are excessively laterally spead and there heat set on the hot drum, and consequently laterally spread web having a stripe-pattern is obtained. Though the laterally spread web having the stripe pattern is sometimes suitable for a specific purpose, only edge parts of the belts are usually wetted with water.

In FIGS. 3*a* and 3*b*, the part where the laterally spread web is withdrawn from upside surfaces of the belts to successive step is shown in an enlarged view. The web is moved onto hot drum 10 through guide rod 9, before the web reaches comb 10, while making the free path as short as possible. At this time, suction chambers 14 are provided at both the ends of hot drum 10 so as to cover the end parts of the drum. Exhausters 15 are provided to apply a suction to the chambers, and the slacked side edge parts of the web are sucked by the negative pressure and are more readily withdrawn onto the drum. At the same time, the slacked parts of the web are readily sucked laterally on the drum towards the end parts of the drum, and the side edge parts of the web are laterally spread thereby, and are longitudinally shortened, resulting in elimination of slacking at both the edge parts of the web on the drum. The side edge parts of the web which have been wetted with water are in the course of drying, whereas the non-wetted, laterally spread middle part of the web is more rapidly heated and more or less shrunk. Thus, a tension develops to pull the wet side edge parts of the web inwards. Therefore, the slacked, wet side edge parts of the web are pulled outwards by the negative pressure suction, and inwards by pulling from the heated, laterally spread middle part. Consequently, laterally spread web having a higher lateral spreading ratio at the side edge parts can be obtained in the present invention after the web is passed over the first hot drum. This is a remarkable feature of laterally spread web, which is suitable for the weft side web of non-woven fabrics based on cross-lamination of weft and warp web layers of split fibers. Of course, the laterally spread web of the present invention can be used as the warp side web, because both the side edges of a cross-laminated, non-woven fabrics are usually cut off after the cross-lamination and pasting of weft and warp webs to obtain products of specific dimensions. Thus, a little difference in fiber densities at both the side edge parts of the laterally spread web of the present invention causes no problem at all.

A suitable length of the belt track for the lateral spreading of the web is usually 5 to 10 times the width of the raw web. If the length of the track is too short, there will be a trouble in guiding the flat belts. The flat belts are liable to be a little inclined or twisted vertically against the laterally spread surface at the end of the planely diverging track, but such a state gives no trouble to supply of water to the side edge parts of the web and lateral speading of the middle part of the web. When belts of circular cross-section are used, the belts sometimes turn over in the laterally spreading process and there would appear such a trouble that the web is entangled with the belts. Therefore, the diameter of the belts should be made larger in the case of the belts having a circular cross-section.

Web of reticular structure obtained by splitting stretched films of polyolefin, polyvinyl chloride, polyvinylidene chloride, polyvinyl alcohol, nylon, polyester or polyacrylonitrile, cellulosic polymer, etc. by means of suitable, well known splitter are effectively laterally spread according to the method of the present invention.

Now, the present invention will be illustrated by way of example.

EXAMPLE

A high density polyethylene film was stretched to 9 times the original length in the longitudinal direction thereof, and the resulting stretched film having a width of 400 mm and a thickness of 0.02 mm was split by means of a splitter having projections similar to those of an ordinary round file. The resulting web of split fibers was placed on a plurality of belts circulating in a planely diverging track on the forwarding route and in a converging track on the returning route between rollers 3 and 4 through pinch rollers 2 at a speed of 60 m/min., as shown in FIG. 1. Only the surfaces of belts 5 on which the side edge parts of the web were placed, were wetted with water containing a very small amount of a surfactant, so as to fix the side edge parts of the web temporarily on said belts. Then, the web was laterally spread with the increasing width of the belt track. Where the web travelled 3.5 m ahead on the belts, the web, laterally spread 3.5 times the original width, was withdrawn onto steam drum 10 having a diameter of 600 mm through guide rod 9, at such a suitable withdrawal speed that the laterally spread web might not reach belt guide comb 11 in a slacking state and might not be imposed any appreciable tension upon the laterally spread web. In this case, the peripheral speed of the hot drum was 57.5 m/min. Suction chambers 14 were provided at both the ends of the hot drum so as to cover more than half of the peripheries of these two ends of the hot drum, and when a suction was effected in the side direction of the drum by means of sirocco fans 15, the slacking side edge parts of the web were more readily withdrawn onto the drum than when without suction, and laterally spread on the drum, while the slacked left side edge being spread to the left side and the slacked right side edge to the right side. In this manner, laterally spread web having a higher lateral spreading ratio at both the side edge parts of the web than the specified lateral spreading ratio at the middle part of the web, that is, a low fiber density at both the edge parts and a width of about 1,400 mm was obtained at a position from hot drum 10 to successive hot drum 10'.

What is claimed is:

1. The method which comprises:

a. feeding a web of split fibers into an inlet roller device over an intervening space and through an outlet roller device, b. supporting only the bottom of said web of split fibers during its movement between said inlet and outlet roller devices by disposing a plurality of narrow belts in supporting contact beneath said web of split fibers, c. said plurality of narrow belts being arranged in a generally side-by-side relationship, but diverging away from each other in the direction in which the web is fed, d. wetting the two outer narrow belts that are on the opposite sides of said plurality of narrow belts and temporarily adhering the lateral edges of said advancing web of split fibers to said two outer wetted narrow belts by virtue of the surface tension of the liquid on said two wetted belts, whereby as the web progresses from the inlet roller device to the outlet roller device it will be laterally spread to an extent corresponding to the diverging distance between said two outer wetted narrow belts, and the unwetted narrow belts that are intermediate said two outer wetted belts being arranged to slideably support the intermediate portion of the underside of said web so that the web is free to move laterally with respect to the surface of the unwetted intermediate belts, and e. operating said outlet roller device at a withdrawal speed which is less than the feeding speed of said inlet roller device by an amount corresponding to the shrinkage of the web in a longitudinal direction that is caused by lateral spreading of said web.

2. A method according to claim 1 wherein the liquid is water containing a small amount of a surfactant.

3. The method which comprises:

a. feeding a web of split fibers into an inlet roller device over an intervening space and through an outlet roller device, b. supporting only the bottom of said web of split fibers during its movement between said inlet and outlet roller devices by disposing a plurality of narrow belts in supporting contact beneath said web of split fibers, c. said plurality of narrow belts being arranged in a generally side-by-side relationship, but diverging away from each other in the direction in which the web is fed, d. wetting the two outer narrow belts that are on the opposite sides of said plurality of narrow belts and temporarily adhering the lateral edges of said advancing web of split fibers to said two outer wetted narrow belts by virtue of the surface tension of the liquid on said two wetted belts, whereby as the web progresses from the inlet roller device to the outer roller device it will be laterally spread to an extent corresponding to the diverging distance between said two outer wetted narrow belts, and the unwetted narrow belts that are intermediate said two outer wetted belts being arranged to slideably support the intermediate portion of the underside of said web so that the web is free to move laterally with respect to the surface of the unwetted intermediate belts, e. operating said outlet roller device at a withdrawal speed which is less than the feeding speed of said inlet roller device by an amount corresponding to the shrinkage of the web in a longitudinal direction that is caused by lateral spreading of said web, and f. passing the web, after it exits from the outlet roller device, over a rotating hot drum and applying suction to the opposite side edge portions of the web along the drum and surfaces, thereby laterally spreading each of the slacked side edge portions of the web outwards by the applied suction on the drum; and drying and heattreating the laterally spread web while passing the laterally spread web over a series of several drums, thereby eliminating strains on the web due to the lateral spreading.

4. A method according to claim 3, wherein the liquid is water containing a small amount of surfactant.

* * * * *